US007182483B2

(12) United States Patent
Stern et al.

(10) Patent No.: US 7,182,483 B2
(45) Date of Patent: Feb. 27, 2007

(54) ILLUMINATING POMPON

(76) Inventors: Deane Stern, 13 Dunning Blvd., Bangor, ME (US) 04401; Hal Meyers, 651 Main Rd., Eddington, ME (US) 04428; John Prince, 2221 Parc Monceau West, Tupelo, MS (US) 38804

( * ) Notice: Subject to any disclaimer, the term of this patent is extended or adjusted under 35 U.S.C. 154(b) by 0 days.

(21) Appl. No.: 10/844,948

(22) Filed: May 13, 2004

(65) Prior Publication Data

US 2005/0254244 A1 Nov. 17, 2005

(51) Int. Cl.
*F21V 33/00* (2006.01)

(52) U.S. Cl. ..... 362/253; 362/109; 428/4; 28/147

(58) Field of Classification Search ..... 362/253, 362/109; 428/4; 28/147
See application file for complete search history.

(56) References Cited

U.S. PATENT DOCUMENTS 4,055,840 A * 10/1977 Uchytil et al. ..... 340/321
4,821,026 A * 4/1989 Newsom ..... 340/574
4,924,358 A * 5/1990 Von Heck ..... 362/555
4,967,321 A * 10/1990 Cimock ..... 362/101
5,079,046 A * 1/1992 Kessler ..... 428/4
6,012,820 A * 1/2000 Weber et al. ..... 362/19
6,161,328 A * 12/2000 Sing ..... 43/137
6,773,329 B2 * 8/2004 Hornsby et al. ..... 446/475

OTHER PUBLICATIONS

U.S. Appl. No. 2002/0141200 to Pan published Oct. 3, 2002.*

* cited by examiner

*Primary Examiner*—Laura K. Tso
(74) *Attorney, Agent, or Firm*—Michael J. Persson; Kieth Blankenship; Lawson & Persson, P.C.

(57) ABSTRACT

An illuminating pompon that includes a handle, a plurality of streamers extending from the handle, and at least one illuminator extending from said handle within said plurality of streamers. The illuminator being adapted to illuminate at least a portion of said plurality of streamers and is in electrical communication with a power source. In the preferred embodiment the illuminators are a plurality of light emitting diodes attached to flexible wires that are controlled with a processor within the power source such that they blink on and off in a predetermined manner.

20 Claims, 4 Drawing Sheets

ILLUMINATING POMPON

FIELD OF THE INVENTION

The present invention relates to pompons for use by cheerleaders and cheering spectators and, in particular, to pompons having enhanced visual interest.

BACKGROUND

Wherever there are athletics, there are spectators. Wherever there are spectators, there are cheerleaders, and wherever there are cheerleaders, there are pompons. Pompons help turn a stadium into a sea of team colors, and it is aesthetically pleasing to see colors in flowing motion. The colors and the agitated movement of the streamers attract the attention of spectators, which is why pompons are standard issue equipment for cheerleaders. Pompons are tools to cheerleaders; they use them to gesture, to rouse attention, to make noise, as dance props, etc. Accordingly, wherever one sees a cheerleader, one can expect to see pompons nearby.

Despite their common association with cheerleaders and spectators at sporting events, pompons are now showing up in the hands of attendees at numerous events outside the sports arenas; political rallies, corporate events, academic events, parades, theme parks, and circuses, to name a few. In each of these uses, pompons enhance the experience by providing enhanced visual stimulation to users and non-users alike, while making the users of the pompons feel like they are part of the event rather than mere spectators.

Current pompons, or shakers, all have a common design. There is a handle, strap, or other means for the user to hold the pompon during use, and a plurality of streamers attached to, and extending from, the handle. Handles may take the form of cylindrical rods, as is the case of most pompons used by spectators, may be substantially D-shaped, as is the case of most common cheerleader pompons, or may simply be flexible straps made of cord, rope, elastic material, or the like. The streamers are typically manufactured of thin strips of plastic or paper material, which are sufficiently flexible to allow the streamers to take a spherical shape, akin to a ball of flowing strips, when the pompons are shaken. The pompon streamers are typically of a single color to match the colors of the team for whom they are used, although a wide variety of streamers, from multicolored streamers to shiny metallic strips, have also been used.

Traditional pompons have been generally effective at generating attention. However, there have been a number of purported improvements thereto. For example, U.S. Pat. No. 5,079,046, entitled "Wrist Pompon Structure", discloses a pompon device that includes an elastomeric tubular sleeve that fits around the user's wrist and a plurality of flexible streamers extending from the front of the sleeve to form a pompon around the users hand. Some embodiments of this device include a squeeze bulb mounted to the sleeve to allow the user to spray glitter particles, formed of reflective material, from the inside of the streamers for an enhanced visual display. This improved pompon is effective at drawing the attention of those near the glitter. However, the small size of the glitter prevents it from being noticed by those who are more than a few feet from the cheerleader. Further, this device creates unwanted litter and must be refilled before each use. Finally, the flying glitter can also be hazardous to the eyes of surrounding spectators. For these reasons, such devices have not found widespread appeal.

Another purported improvement is found in U.S. Pat. No. 5,079,046, entitled "Pompon". This patent discloses a traditionally styled pompon made up of flexible streamers formed of transparent plastic with a fluorescent dye. When the plastic is cut to form the streamers, the cut edges are said to provide a glowing effect in the presence of ambient light, enhancing the visual effect of the pompon. Unfortunately, the use of such fluorescent dyes does not significantly enhance the visibility of the pompons at long distances. In addition, such pompons rely upon the reflection of ambient light to produce their effect and are ineffective in low light conditions, such as when the lights are dimmed during player introductions, during evening pep rallies, parades, and the like. Finally, the design of these pompons precludes the use of streamers in "team" colors, as is typically required. Accordingly, these devices have also not found widespread appeal.

Therefore, there is a need for an improved pompon that will be effective at generating attention of people who are a great distance from the user of the pompon, that does not produce litter, that does not need to be refurbished after each use, that does not create a safety hazard, that has enhanced visibility even in low light conditions, and that includes streamers that are in "team" colors.

SUMMARY OF THE INVENTION

The present invention is an illuminating pompon that provides an enhanced visual display. The illuminating pompon utilizes at least one illuminator disposed within the streamers of the pompon, which moves with, and effectively illuminates, the streamers; commanding the attention of a spectator from near and far. The pompon of the present invention is sanitary and clean, portable, reliable, lightweight to avoid injury if thrown or tossed, and is amenable to a broad range of activities by both spectators and cheerleaders alike.

In its most basic form, the illuminating pompon includes a handle, multiple streamers, one or more illuminators, and a power source. The handle acts as a holding surface capable of being grasped by the human hand. Two preferred handles include a rod handle, prevalent in common spectator shakers; and a D-shaped handle, prevalent in cheerleading shakers.

Extending from the handle are streamers. Streamers vary in size, shape, quantity and color. Streamers of lower cost pompons are typically thin semi-transparent ribbons, while higher end pompons include streamers that are typically more compact, thicker ribbons. Similarly, the quantity of streamers should be adequate to create a weighted handle, which allows for smoother agitation of the streamers, although cost considerations may require that more or less streamers be used in a particular model of pompon. Accordingly, any combination of streamer size, shape, and/or quantity that is capable of agitation will suffice, and the present invention should not be seen as being limited to any particular embodiment or combination thereof.

The illuminator acts to shine light on and through the streamers and is positioned accordingly. The illuminator may be a simple bulb, light emitting diode (LED), or other light emission device that is a capable of moving with and illuminating the streamers during use such that the illuminator convulses as the handle is displaced. The illuminators of the preferred embodiment are three LED's that attach to flexible wires. The flexible wires are in communication with the power source within the handle and terminate at three different (staggered) points starting near the handle and ending at a point near but hidden within the tips of the streamers. In this preferred embodiment, the LED's are caused to blink in a predetermined pattern by an integrated circuit that is powered by three AG13 style button batteries. However, illuminators using other art-recognized lights, numbers of lights and power sources may also be used.

The power source of the preferred pompon includes a switch that extends through the handle and dimensioned to allow a user to control an operation of said pompon. The power source preferably also includes a processor adapted to control a flow of power to the illuminator. In some embodiments, the processor is adapted to control a flow of power to said illuminator such that said illuminator blinks on and off in a predetermined sequence. In others, such as those that also include a speaker, the processor is adapted to control sounds emanating from said speaker and to control a flow of power to the illuminator based upon said sounds emanating from said speaker. Finally, in some embodiments the power source also includes a means for inputting data for use by said processor.

In some embodiments of the pompon, the streamers and/or illuminators are removable to allow different combinations of streamers and illuminators to be used. Some such embodiments are readily adapted for sale in kit form, and the present invention completes such a kit.

Therefore, it is an aspect of the invention to provide a pompon that utilizes a self-generated light source to illuminate effectively its streamers.

It is a further aspect of the invention to provide a pompon that commands the attention of a spectator from near and far.

It is a further aspect of the invention to provide a pompon that is reliable, sanitary, clean and portable.

It is a further aspect of the invention to provide a pompon that is aesthetically pleasing and amenable to cheer routines.

It is a further aspect of the invention to provide a pompon that is lightweight to avoid injury if thrown or tossed.

It is a further aspect of the invention to provide a pompon that does not produce litter.

It is a further aspect of the invention to provide a pompon that does not need to be refurbished after each use.

It is a further aspect of the invention to provide a pompon that does not create a safety hazard.

It is a further aspect of the invention to provide a pompon that has enhanced visibility even in low light conditions.

It is a further aspect of the invention to provide a pompon that may include removable streamers and/or illuminators to vary the effect of said pompon based upon a particular occasion.

It is a further aspect of the invention to provide a pompon that is readily adapted for sales in kit form.

It is a still further aspect of the invention to provide a pompon and that includes streamers that are in "team" colors.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
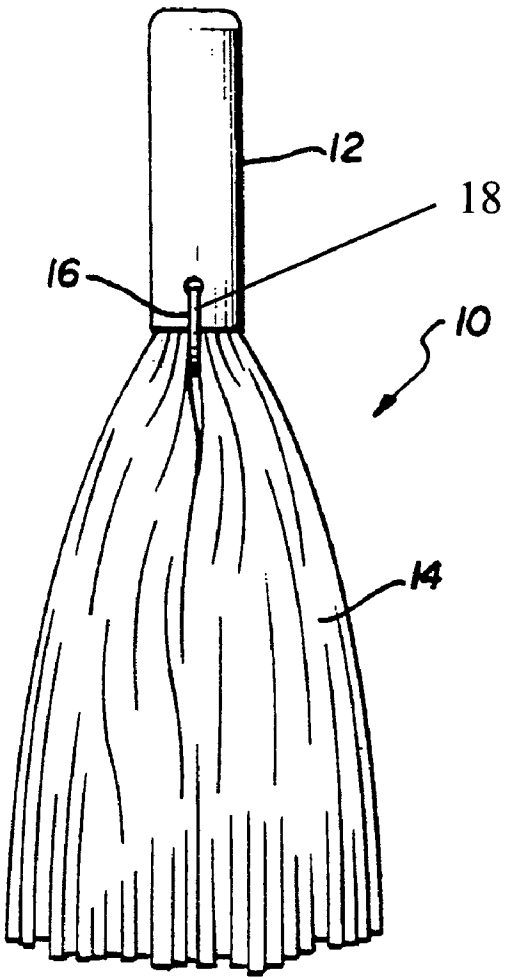
FIG. 1 PRIOR ART
FIG. 1 is a side isometric view of a prior art pompon.

Referring first to FIG. 1, a prior art pompon 10 is shown. The pompon 10 of FIG. 1 includes a substantially cylindrical handle 12 and a plurality of streamers 14 that extend therefrom. The streamers 14 are attached to the handle 12 by means of a plastic cable tie 16 that is threaded through an opening 18 proximate to the end of the handle 12, tightened about a midsection of a bundle of streamers 14, and secured thereto.

Figure 2:
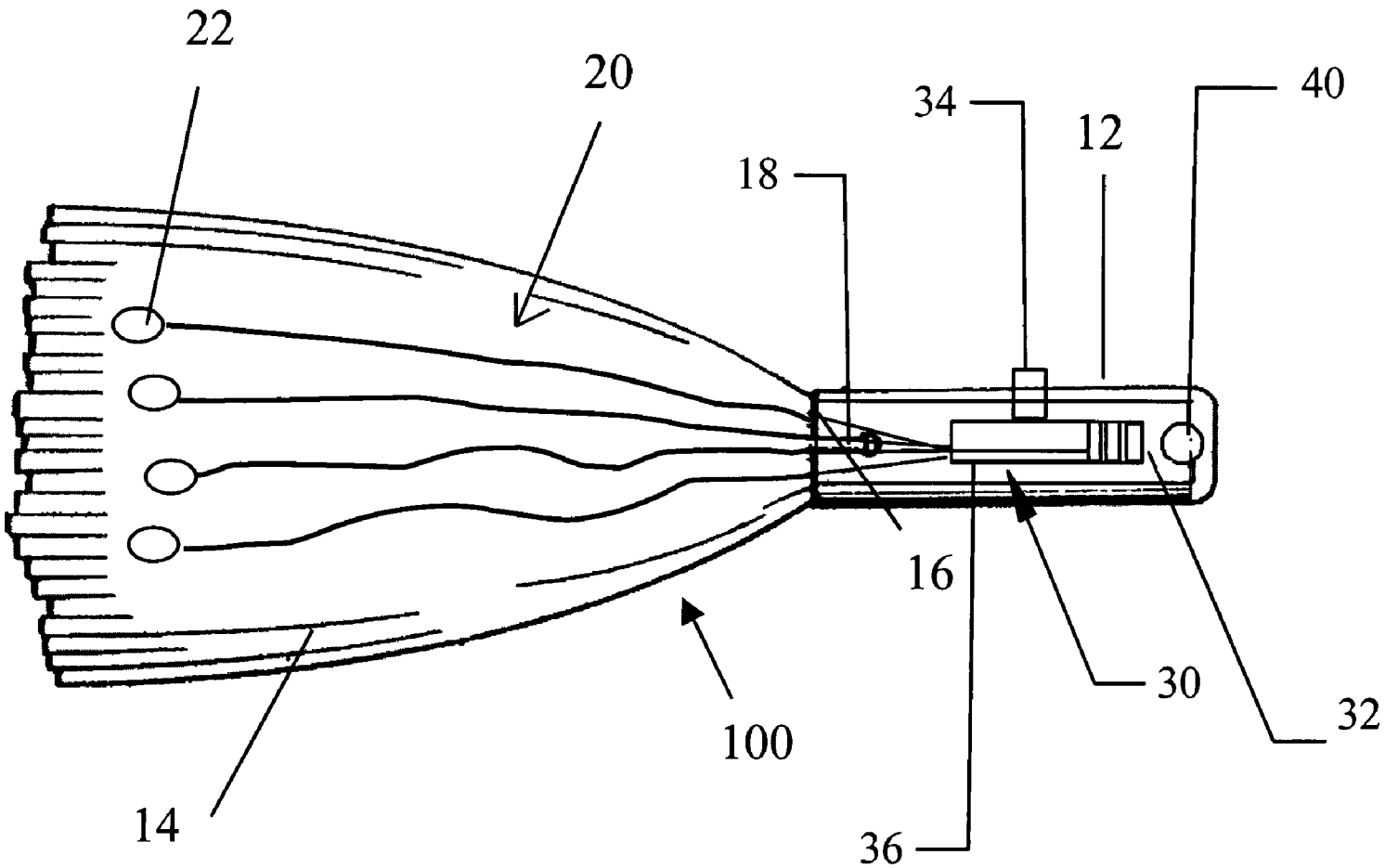
FIG. 2 is a cut away side view of the preferred embodiment of the pompon of the present invention in which streamers are cut away to reveal a plurality of illuminators and in which the handle is cut away to show the power source, on/off switch, and "replaceable battery" compartment.

Referring now to FIG. 2, one embodiment of the illuminating pompon 100 of the present invention is shown. Like the prior art pompon 10 of FIG. 1, the pompon 100 of the present invention includes a handle 12 and streamers 14 extending therefrom. Likewise, the streamers 14 of this embodiment are attached to the handle 12 using the same cable tie 16 and hole 18 arrangement of the prior art pompon 10 of FIG. 1.

The streamers 14 of the pompon 100 may vary in size, shape, quantity and color. In embodiments of the pompon 100 designed for spectator use, the streamers 14 are preferably long, thin semi-transparent ribbons, while those designed for cheerleader use are preferably more compact, thicket ribbons. However, the specific dimensions of the streamers 14 are not critical to the operation of the invention and all sizes and shapes of streamers 14 capable of agitation will suffice.

The materials from which the streamers 14 may be made are plentiful and, again, any material capable of agitation when waved through the air will suffice. A preferred material is a semi-transparent Mylar® plastic, due to its ability to allow light to pass and reflect off it's surface, its low cost, availability in a rainbow of colors and water resistance. However, streamers 14 manufactured out of reflecting materials may be used to enhance the visual affect from the illuminators 20.

There is no specific number of streamers 14 to be used in the present invention. Pompons 100 having a large number of streamers 14 are preferred, but any number of streamers 14 that allow a viewer of the pompon 100 of the present invention to recognize the invention as a pompon 100 is acceptable. The quantity of streamers 14 is preferably adequate to create a weighted handle, which allows for smoother agitation of the streamers 14, and preferably is of a sufficient number to hide the presence of the illuminators 20 disposed therein when the illuminators 20 are powered off. In all versions of the pompon 100 of the present invention, it is likewise preferred that enough streamers 14 attach to the handle 12 to create a fluffy appearance.

The pompon 100 of the present invention differs from prior art pompons, such as those shown in FIG. 1, in that the pompon 100 includes at least one illuminator 20 that extends from the handle 12, where it is connected to, and powered by, a power source 30 disposed within the hollow interior 13 of the handle 12. The illuminator 20 acts to shine light on the streamers 14 and is positioned within the streamers 14.

The illuminators 20 of FIG. 2 are each disposed a substantially uniform distance from the tips 15 of the streamers 14 and are positioned such that they illuminates at least the tips 15 of the streamers 14, which is the region of the streamers 14 that is visible when the pompon 100 is shaken. However, it is preferred that the illuminators 20 be arranged in a staggered arrangement, similar to that shown in FIG. 4, in which the illuminators 20 are positioned throughout the streamers 14 to provide illumination of a substantial portion thereof, and in which the final illuminator 20 terminates at about two to three inches from the tips 15 of the streamers 14.

The illuminator 20 may include an incandescent bulb, light emitting diode (LED), or other art recognized light source, provided that the illuminator 20 is positioned within the streamers 14 and is substantially flexible such that it will move with the streamers 14 when the handle 12 is displaced. The illuminator 20 need not have the same degree of flexibility as the streamers 14 and, in fact, it likely will not due to material considerations. One significant material consideration is strength. The illuminator 20 is preferably manufactured of a stronger material than the streamers 14, because certain embodiments, such as the embodiment shown in FIG. 2, employ light sources 22 on the tips of the substantially flexible illuminators 20. Thus, substantially flexible should be understood as meaning that the illuminator 20 is capable of a movement path distinct from that of the handle at the same time as the streamers 14 are moved, and not necessarily in the same direction or frequency as the streamers 14.

As shown in FIG. 2, one preferred embodiment of the pompon 100 includes three illuminators 20, each of which is made up of a substantially flexible two conductor electrical cable 24 and a LED 22, which serves as its light source. In the preferred embodiment, the electrical cable 24 takes the form shown in FIG. 4, in which it does not include an outer insulator and each of the two insulated conductors appear as separate single conductor insulated wires 21, 23, each having an outer diameter of between about 0.020 and 0.040 inches. This arrangement adds to the overall flexibility of the cable 24, allowing the LEDs 22 to move in a manner almost identical to that of the streamers 14 when the pompom is shaken, and allows the cable 24 to be easily soldered to the terminals of the LED 22 and attached to the power source 30. However, as shown in FIG. 2, cables 24 having insulators about each of the two conductors may be used provided they are remain substantially flexible, as defined herein.

The preferred pompon 100 utilizes between two and six illuminators 20, although single illuminator versions, or those utilizing more than six illuminators 20 are contemplated. As noted above, the preferred light sources for the illuminators 20 are LED 22. These are preferred due to their brightness, low power consumption, small size, lower operating temperatures and long life. The preferred embodiment uses various colored LED 22, chosen based upon and or relating to a particular event, team, occasion, etc. These LED 22 are preferably caused to blink on and off in unison by the power source 30, creating a flashing effect akin to light bursts through the pompon 100. However, as discussed below, other embodiments may utilize LED 22 of different colors and/or power sources that create different lighting effects upon the pompon.

The cables 24 of the illuminators 20 terminate at the power source 30 within the handle 12. In its most basic form, the power source 30 is merely a battery, or batteries 32, that is placed in electrical communication with the cables 24 and provide continuous power to the illuminators 20 in a manner similar to that of an inexpensive flashlight. However, as shown in FIG. 2, it is preferred that the power source 30 include a battery 32, an on/off switch 34, and a circuit board 36 to which the on/off switch 34, batteries 32 and terminations of the cables 24 are wired. As discussed in detail below with reference to FIG. 3, the circuit board 36 may include a processor 50 and various other inputs and outputs to enhance the functionality and versatility of the pompon 100.

In the preferred embodiment, three AG13 type button batteries 32 are utilized. These are preferred due to their small size and low weight. However, other embodiments may use more readily available disposable batteries, such as AA, AAA, or lithium ion batteries of sizes uses in cameras or other electronic equipment, or rechargeable batteries, such as those typically used in cellular phones, PDA's or the like.

As noted above, both the streamers 14 and the cables 24 of the illuminators 20 extend from the handle 12 of the pompon 100. The handle 12 of the present invention serves multiple functions. The preferred handle 12 acts as a gripping surface to allow the human hand to displace the invention, as a housing to hold and protect the power source 30, and as a display surface for imprinting or hot stamping logos or attaching logo stickers that identify the pompon 100 with a particular team or organization.

Figure 4:
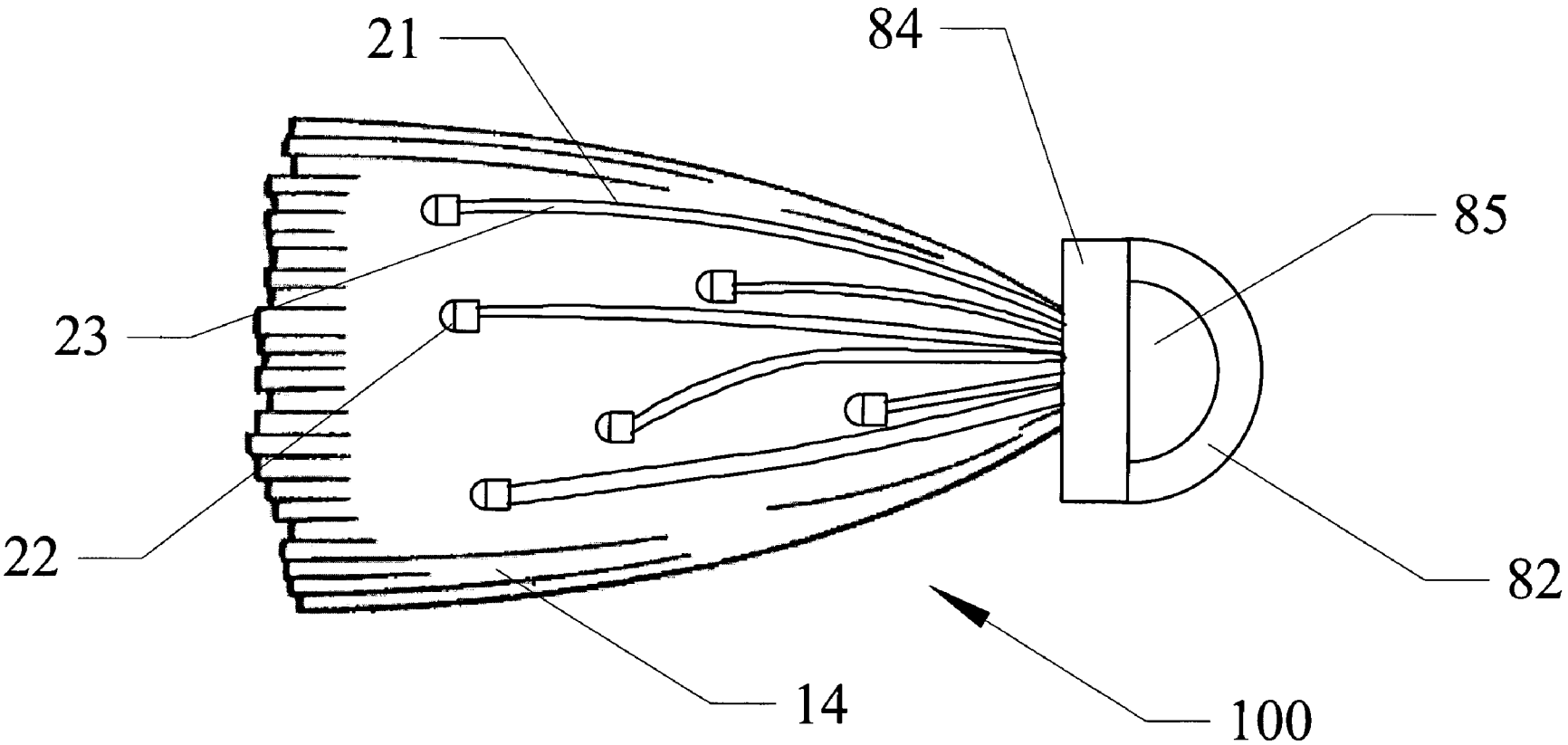
FIG. 4 is side view of an alternative embodiment of the pompon of the present invention in which the handle is a D-shaped and in which the streamers are cut way to reveal a plurality of illuminators staggered at varying distances from the tips of the streamers.

The handle 12 may be any size and shape in which a human hand may maintain a grip upon it. As shown in FIG. 4, the cheerleader version of the pompon 100 preferably utilizes a D-shaped handle 12. However, as shown in FIG. 2, the preferred handle 12 takes the form a hollow substantially cylindrical rod. The handle 12 may be made of any material, provided it is relatively lightweight and may be readily formed into the desired shape. The preferred material for the handle 12 is plastic due to its lightweight, low cost, and ease of molding, forming and machining. However, handles manufactured of metal, wood or rubber materials may likewise be utilized to achieve similar results.

In the current commercial embodiment of the pompon 100, the handle 12 is sealed such that the user may not access the power supply 30. Such a sealed handle is utilized to make the pompon 100 child-safe, and to reduce the material and assembly costs of the pompon 100. However, batteries 32 have a limited life and the ability to replace the batteries would be advantageous, especially in higher cost embodiments of the pompon 100. To facilitate such replacement, that the handle 12 may include fasteners that divide the handle 12 into two detachable sections. The sections need not be equal, nor need there be two, but rather should be sized and shaped to allow removal and replacement of the batteries 32, or other internal components within the handle 12. The preferred embodiment has a battery compartment to house three AG13 batteries with a removable battery door/cover, allowing the end user to replace the batteries should they lose power. The battery compartment cover is held in place with a fastener, preferably a screw. The screw ensures the battery compartment door will remain shut during the shaking motion, and prevents youngsters from easily removing the batteries.

As shown in FIG. 2, the handle 12 of preferred pompon 100 also includes an opening 40 through which a wrist strap (not shown) may be attached to the end of the handle 12. This strap is designed to wrap around the wrist of the user during operation and prevent the pompon 100 from being inadvertently dropped or thrown. It is preferred that this strap be manufactured of an elastic material, similar to that of a small diameter bungee cord. However, other embodiments may utilize nylon straps having hook and loop fasteners attached thereto, non-elastic cords with mechanical fastening means attached thereto, or any other art recognized means for securing a loop around a human wrist.

Figure 3:
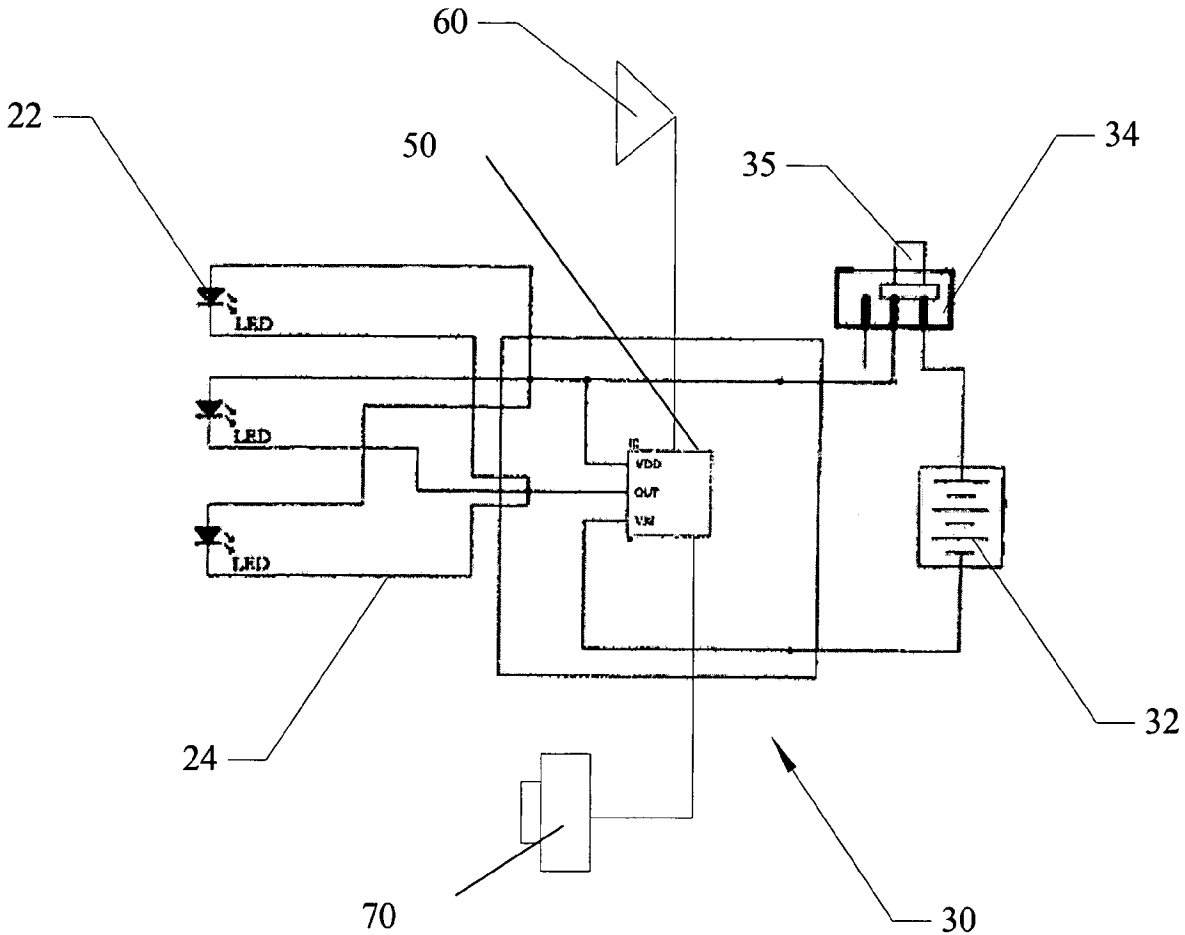
FIG. 3 is a circuit diagram showing the circuitry of one embodiment of the present invention.

Referring now to FIG. 3, a wiring diagram for a preferred embodiment of the pompon 100 is shown. This embodiment includes a the same illuminators 20 as described above, including LED 22 and power cords, and the power source 30 is likewise made up a battery 32, switch 34. However, the preferred power source 30 also includes a processor 50, which controls the flow of power from the battery 32 to the illuminators. In the diagram of FIG. 3, the processor 50 is an integrated circuit. However, in other embodiments of the pompon 100, the processor 50 may take the form of a microprocessor and memory device, or other art recognized means for controlling a flow of power to lights, sound devices, or the like.

In the preferred embodiment, the processor 50 is designed to blink the LED 22 at regular staggered intervals. However, in other embodiments the processor 50 is programmed to blink the LED 22 in different sequences, such as each LED 22 lights in unison, or at different times and/or for different intervals. As shown in FIG. 3, some embodiments of the pompon 100 also include a speaker 60 for playing sounds. In these embodiments, the processor 50 is adapted to control both the power output to the LED 22 and the sound output to the speaker 60, and may be further adapted to coordinate the output of power to the LED 22 to coincide with the sounds being broadcast through the speaker 60. In addition, it is contemplated that some embodiments will include means of inputting data 70 such as a flash memory card or other removable memory device, to allow the processor 50 to coordinate a wide variety of lighting sequences and/or sounds.

As described with reference to FIG. 2, the switch 34 may be any switch capable of turning the power source 30 off and on. However, in embodiments in which lighting sequences and/or sounds are user controlled, it is preferred that the switch 34 include at least one control button 35 that allows the user to toggling between each of the various modes of operation.

As shown in FIG. 4, another embodiment of the pompon 100 of the present invention is shown. In this embodiment, the handle 12 is substantially D-Shaped and includes a gripping portion 82 and an electrical portion 84 that define an opening 85. The gripping portion 82 is the portion that the user holds during use and, accordingly, the opening 85 should be sized such that a user may insert at least two fingers therebetween, with an opening 85 sized to accommodate four fingers being preferred. The gripping portion 82 to may be smooth, as shown in FIG. 4, or may be ergonomically shaped to conform to the hand of the user, and is attached to the electrical portion 84 such that the movement of the gripping portion 82 causes the electrical portion 82 to move.

The streamers 14 are attached to the electrical portion 82 of the handle 12 via a fastener (not shown) and the illuminators 20 extend into the handle 12 and attach to the power supply (not shown) located therein. The arrangement of the interior of the electrical portion 82 of the handle 12 is a simple matter of design choice and, therefore, the interior of the electrical portion 82 has not been shown here in FIG. 4. However, it is recognized that of the power supply 30 may be the power supply 30 described with reference to FIG. 2, or one of the many embodiments of the power supply 30 described with reference to FIG. 3. Accordingly, embodiments utilizing a D-shaped handle 12 should not be seen as being so limited.

The inventors likewise recognize some embodiments of the pompon 100 include the ability to modify the colors and/or textures of the streamers 14 and the colors of illuminators 20 to meet a particular circumstance. This capability has a number of advantages. For example, a retailer of cheerleading supplies may wish to only stock a limited number handles 14 and pre-assemble the pompons 100 based upon the specific streamers 14 and illuminators 20 chosen by the customer. Similarly, cheerleaders could vary the colors of streamers based upon the occasion; ex. change from red, white and blue streamers 14 with white illuminators 20 for an Independence Day parade to black streamers 14 with orange illuminators 20 for a Halloween parade. In such circumstances, it is likewise contemplated that the pompon 100 would be sold in kit form in which the purchaser would purchase the streamers 14, handle 12 and illuminators 20 and assemble them as desired.

The interchangeability of streamers 14 and illuminators 20 may be accomplished by a number of ways. For example, the cable tie 16 of FIGS. 1 and 2 may be a replaced with a removable strap that allows the streamers 14 to be removed and new streamers 14 to be inserted and secured. In other embodiments, he handle 12 could have a threaded cap through which the streamers 14 would extend and be secured once threaded onto the handle 12. Similarly, the illuminators 20 may have removable bulbs, like the LED of FIGS. 2 and 4, or the cables 24 may include connectors that allow the illuminators 20 to be plugged into a mating connector in the handle. As the myriad ways in which the streamers 14 and illuminators 20 are made replaceable would be readily apparent to those of skill in the art, further elaboration is not provided herein. However, it should be recognized that such replaceability is one aspect of the present invention.

Although the present invention has been described in considerable detail with references to certain preferred versions thereof, other versions would be readily apparent those of ordinary skill in the art. Therefore, the spirit and scope of the appended claims should not be limited to the description of the preferred versions contains herein.

What is claimed is:

1. An illuminating pompon comprising:

a handle;

a plurality of streamers extending from said handle;

at least one illuminator extending from said handle within said plurality of streamers, said illuminator being adapted to illuminate at least a portion of said plurality of streamers; and a power source in electrical communication with said illuminator.

2. The pompon of claim 1 wherein said illuminator is substantially flexible.

3. The pompon of claim 2 wherein said illuminator comprises:

a flexible wire; and a light source positioned on said wire to illuminate a substantial portion of said plurality of streamers.

4. The pompon of claim 3 wherein said light source is a light emitting diode.

5. The pompon of claim 2 wherein said power source is disposed within said handle.

6. The pompon of claim 5 wherein said power source further comprises a switch extending through said handle and dimensioned to allow a user to control an operation of said pompon.

7. The pompon of claim 6 wherein said power source further comprises a processor and wherein said processor is adapted to control a flow of power to with said illuminator.

8. The pompon of claim 7 wherein said processor is adapted to control a flow of power to said illuminator such that said illuminator blinks on and off in a predetermined sequence.

9. The pompon of claim 8 further comprising a speaker, wherein said processor is adapted to control sounds emanating from said speaker.

10. The pompon of claim 9 wherein said processor is adapted to control a flow of power to said illuminator based upon said sounds emanating from said speaker.

11. The pompon of claim 7 wherein said power source further comprises a means for inputting data for use by said processor.

12. The pompon of claim 1 wherein said handle is substantially rod shaped.

13. The pompon of claim 1 wherein said handle is substantially D-shaped.

14. A kit for forming an illuminating pompon comprising:

a plurality of streamers;

at least one illuminator; and a handle comprising a power source, means for attaching said streamers to said handle, and means for attaching said at least one illuminator to said power source;

wherein said at least one illuminator is dimensioned to extend from said handle within said plurality of streamers; and wherein said at least one illuminator is attached to said power source and said streamers are attached to said handle such that said at least one illuminator is disposed within said plurality of streamers to form said illuminated pompon.

15. The kit of claim 14 wherein said illuminator comprises:

a flexible wire; and a light emitting diode positioned on said wire to illuminate a substantial portion of said plurality of streamers.

16. The kit of claim 14 wherein said power source further comprises a processor and wherein said processor is adapted to control a flow of power to said illuminator.

17. The kit of claim 16 wherein said processor is adapted to control a flow of power to said illuminator such that said illuminator blinks on and off in a predetermined sequence.

18. The kit of claim 16 further comprising a speaker, wherein said processor is adapted to control sounds emanating from said speaker.

19. The kit of claim 18 wherein said processor is adapted to control a flow of power to said illuminator based upon said sounds emanating from said speaker.

20. The kit of claim 16 wherein said power source further comprises a means for inputting data for use by said processor.

* * * * *